US009316062B2

(12) United States Patent
Emerson et al.

(10) Patent No.: US 9,316,062 B2
(45) Date of Patent: Apr. 19, 2016

(54) COILED TUBING TRIPLE-SEALED PENETRATOR AND METHOD

(75) Inventors: Tod D. Emerson, Cypress, TX (US); Jerry L. Reeves, Houston, TX (US); Michael E. Daugherty, Houston, TX (US); Leroy Cantu, Manvel, TX (US)

(73) Assignee: QUICK CONNECTORS, INC., Houston, TX (US)

( * ) Notice: Subject to any disclaimer, the term of this patent is extended or adjusted under 35 U.S.C. 154(b) by 409 days.

(21) Appl. No.: 13/992,815

(22) PCT Filed: Dec. 12, 2011

(86) PCT No.: PCT/US2011/064383

§ 371 (c)(1), (2), (4) Date: Jul. 1, 2013

(87) PCT Pub. No.: WO2012/079071

PCT Pub. Date: Jun. 14, 2012

(65) Prior Publication Data

US 2013/0277067 A1 Oct. 24, 2013

Related U.S. Application Data

(60) Provisional application No. 61/422,038, filed on Dec. 10, 2010.

(51) Int. Cl.

| | |
|---|---|
| ***E21B 17/00*** | (2006.01) |
| ***E21B 33/04*** | (2006.01) |
| ***E21B 17/02*** | (2006.01) |

(52) U.S. Cl.

CPC ..... *E21B 17/003* (2013.01); *E21B 17/028* (2013.01); *E21B 33/0407* (2013.01)

(58) Field of Classification Search

CPC . E21B 33/0407; E21B 17/003; E21B 17/028; E21B 17/206; E21B 33/03; H01R 13/533; H01R 13/5205; H01R 13/5208

See application file for complete search history.

(56) References Cited

U.S. PATENT DOCUMENTS

| | | | | | |
|---|---|---|---|---|---|
| 3,437,149 | A * | 4/1969 | Cugini | E21B 17/003 | 166/379 |
| 3,781,456 | A * | 12/1973 | Knowles | E21B 33/03 | 166/379 |
| 4,583,804 | A * | 4/1986 | Thompson | H01R 13/533 | 439/470 |
| 5,289,882 | A * | 3/1994 | Moore | E21B 17/003 | 166/379 |
| 5,762,135 | A * | 6/1998 | Moore | E21B 17/003 | 166/379 |
| 6,332,499 | B1 * | 12/2001 | Kobylinski | E21B 17/028 | 166/242.6 |
| 6,688,386 | B2 * | 2/2004 | Cornelssen | E21B 33/0407 | 166/65.1 |
| 6,761,574 | B1 * | 7/2004 | Song | E21B 4/18 | 285/39 |
| 6,910,870 | B2 * | 6/2005 | Ebner | F04D 29/426 | 166/65.1 |

(Continued)

*Primary Examiner* — Daniel P Stephenson
(74) *Attorney, Agent, or Firm* — David B. Dickinson

(57) ABSTRACT

A triple-sealed ESP connection provides a first seal at the upper end of a coiled tubing to limit the migration of vapors from the interior of the coiled tubing into the annulus at a wellhead and a second seal to prevent migration of the vapors from the annulus of the wellhead to the exterior surface of the wellhead. This triple-sealed arrangement can be accomplished by providing a threaded connection on an upper end of the coiled tubing to which is attached the sealable shroud for the electrical conductor splice which sealably connects with the wellhead thereby providing a sealed upper end to the coiled tubing and a second seal on the shroud and a seal at the wellhead. The second seal in both cases is the seal that can be either a metal-to-metal or other type of compressive seal arrangement or a sealed tubing arrangement.

7 Claims, 4 Drawing Sheets

(56) References Cited

U.S. PATENT DOCUMENTS 7,232,347 B1 * 6/2007 Moore ..... H02G 15/013 174/89
7,405,358 B2 * 7/2008 Emerson ..... H02G 15/18 174/88 R
7,665,480 B2 * 2/2010 Angelosanto ..... F04B 53/04 137/15.11
8,297,345 B2 * 10/2012 Emerson ..... H01R 13/523 166/242.6
2008/0026623 A1 * 1/2008 Emerson ..... E21B 43/128 439/275
2008/0110644 A1 * 5/2008 Howell ..... E21B 17/028 166/387
2013/0277067 A1 * 10/2013 Emerson ..... E21B 17/003 166/378

* cited by examiner

DETAIL A

DETAIL B

COILED TUBING TRIPLE-SEALED PENETRATOR AND METHOD

BACKGROUND OF INVENTION

The present invention relates to a connection for coiled tubing; more specifically, to a triple-sealed penetrator permitting the deployment of an electrical submersible pump into a well bore on coiled tubing creating barriers preventing the migration of well bore gases and fluids through the coiled tubing to the surface or from the annulus of the wellhead to the electrical connection within the wellbore.

The deployment of electrical submersible pumps (ESP) around the world is becoming more common as existing geophysical pressures decline in oil and gas producing areas. ESPs frequently require repair or replacement; requiring deployment of workover rigs to each well to pull the existing pump and replace it after servicing. Operators of such equipment have long sought to replace the need for workover rigs by utilizing coiled tubing injector head assemblies, which are smaller and easier to move onto a well site. Since the tubing is continuous, the deployment of an ESP can be accomplished in as little as one hour, as opposed to a workover rig requiring a day or more of rig time. Previous attempts to use coiled tubing to run ESPs in wells were problematical because of the expansion and contraction of the electrical conductors within the coiled tubing from natural relaxation of the tubing after installation or from heating and cooling cycles during operation of the ESP. This caused operators to spiral excess slack from the electrical conductors in the annulus adjacent the wellhead to permit the expansion and contraction of the conductors within the well bore. Now, operators have developed an electrical conductor coiled tubing operation that avoids this problem by fixing the electrical conductor within the coiled tubing, thereby preventing excessive movement within the coiled tubing and permitting lighter stuffing box canister arrangements. This reduced size and weight has increased the owners' attention to sealing the ESP cable within the wellbore to prevent egress of dangerous explosive vapors. Demand for a seal on both the coiled tubing and the wellhead leads to the present embodiments.

SUMMARY OF INVENTION

A coiled tubing termination of the present invention provides a first pressure seal on a terminal end of a coiled tubing which accommodates the passage of electrical conductors from the interior of the coiled tubing; a connector for each of a plurality of electrical conductors; and, a second pressure seal on a penetrator assembly, sealing the electrical conductors.

This apparatus could also provide a capillary tube connection adapted to permit a capillary tube to be connected in a well bore and down a coiled tubing through a first seal on the coiled tubing, a seal on the top of the electrical splice, and to the surface through a second seal in a wellhead. The connector can be threaded on the coiled tubing terminal end; or alternatively, could provide a threaded sleeve attached to a coiled tubing terminal end adapted for sealing the electrical conductors within an annulus of the wellhead.

A method of installation for a coiled tubing penetrator using a simple sealed canister or tubing can be accomplished by creating a threaded end on the coiled tubing; stripping the electrical conductors carried in the coiled tubing; enclosing each of the conductors in a sealed threaded connector sleeve; and connecting each conductor from the sealed threaded connector sleeve through a pressure-sealed wellhead to thereby provide a first seal between the end of the coiled tubing, a seal on the electrical connections and a third seal from interior of the wellhead to the surface connections.

An alternative method of installation for this coiled tubing penetrator can be accomplished by hanging a coiled tubing in a wellhead connected to an ESP; connecting an exterior surface of the coiled tubing to a shroud; connecting a plurality of electrical conductors from the coiled tubing to a plurality of electrical conductors extending from a wellhead penetrator, and sealing the top of the shroud with a gland and tubing compression fitting assembly, sometimes referred to as a Swagelok®, preventing vapors from the coiled tubing from migrating past the electrical connectors into the annulus of the wellhead; and, sealingly connecting the electrical connectors through the wellhead to surface connections with either metal-to-metal or PEEK compression seals thereby preventing the migration of vapors from the annulus of the wellhead and leaking into the area adjacent the wellhead.

DETAILED DESCRIPTION OF INVENTION

Figures 1, 1A, 1B:
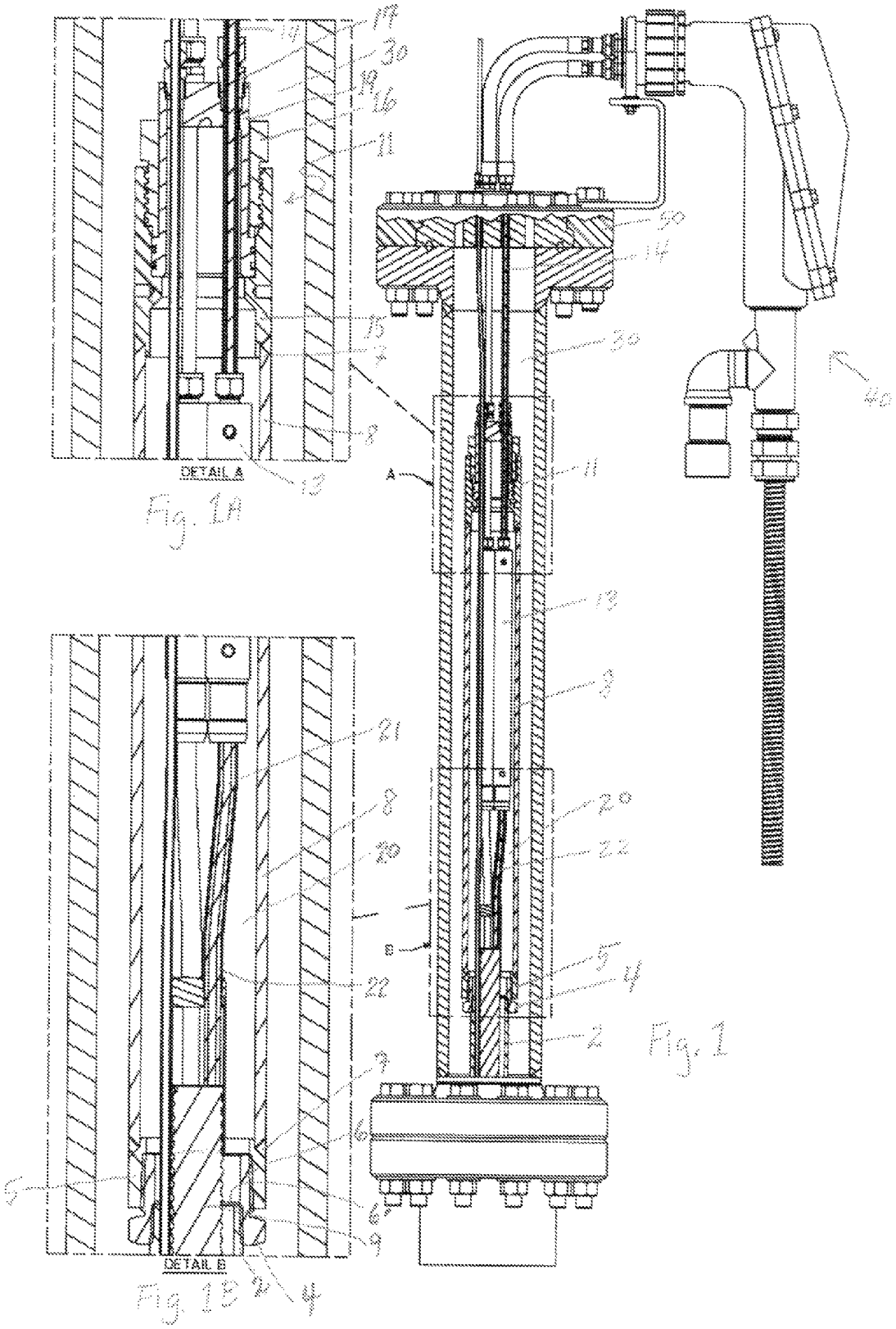
FIG. 1 is a completed assembly cross-sectional drawing of a triple-sealed coiled tubing.
FIG. 1A is a detailed view of the upper seal on the shroud.
FIG. 1B is a detailed view of the lower sealed connection to the coiled tubing.

All the present embodiments of this invention contain a mechanism or apparatus for creating a triple-sealed barrier, preventing the escape of vapors from a well bore. As shown in FIG. 1, the first seal is created at the top of the coiled tubing 2, which is an economical and efficient means for deploying and retrieving ESPs. If the coiled tubing is compromised during deployment, migrating vapors will first be stopped at the top of the terminated coiled tubing 2 hung in the well bore. The second seal 11 is located between the interior of the wellhead 30 and the exterior of the wellhead 40. ESP cabling currently in use accomplishes vapor containment using stainless steel tubing 14, sealed in the wellhead stuffing box by compression fittings, over each conductor to limit inductive heating from the electrical current flowing through the separated conductors.

One embodiment of the present invention is shown in FIG. 1 (and in more detail in FIG. 1A and FIG. 1B) and describes a coiled tubing 2 hung in a conventional manner (not shown) in a well bore. At the top of the coiled tubing is a coiled tubing bushing 5 integrally attached, such as by welding, to a shroud or sleeve 8 having inner thread 6' and outer threads 6 as more clearly shown in FIG. 1B, which is welded to the sleeve 4 that is threadably attached to the coiled tubing 2 by threading onto the top of the coiled tubing exterior surface. The sleeve 4 provides a tapered threaded connection, or NPT connection 6, onto which is screwed a shroud 8 enclosing an annular interior space 20 containing the three separated electrical conductors 21 which run through a triskelion 22 inserted over the three separate conductors from the cable 9 carried in the coiled tubing 2. The three electrical conductors 21 are connected, such as shown, by crimping to electrical conductors running through the wellhead from the surface and sealed on the interior of the shroud; all in a manner described in U.S. Pat. No. 7,980,873. As shown in FIG. 1, the shroud 8 is sealed 11 from the annular space 30 adjacent the interior of the wellhead thereby preventing migration of vapors that may have penetrated the coiled tubing 2. The seal assembly 11 as more clearly shown in FIG. 1A, is composed of a threaded cap head seat 15 welded at 7 to the top of the shroud 8 into which is secured in the cap head 19 having threaded connections for compressive sealing 17 of the tubes containing the conductors from the well head penetrator into the body of the sealed shroud 8 retained in the cap head seat 15 by a cap head nut 16. Stainless steel tubes 13 enclose each conductor penetrating the sealed wellhead where they are connected in a manner well known in this art to a standard surface cable 40 as shown in FIG. 1A. The stainless steel tubing protecting the electrical conductors is sealed within the wellhead penetrator and the shroud or sleeve penetrator with either metal-to-metal compressive fittings using metal ferrules or utilizing PEEK (polyether ether ketone) ferrules.

Vapors entering the coiled tubing 2 are retained within the sealed inner shroud 8 creating the first seal 2, 4 of this triple-sealed barrier. The tubes entering the well head penetrator 50 prevent migration of vapors to the atmosphere and thus complete this triple-sealed vapor barrier permitting the use of coiled tubing to support a conductor to an ESP assembly thereby allowing deployment of ESP with coiled tubing injection head rather than a costly workover rig.

Figure 2:
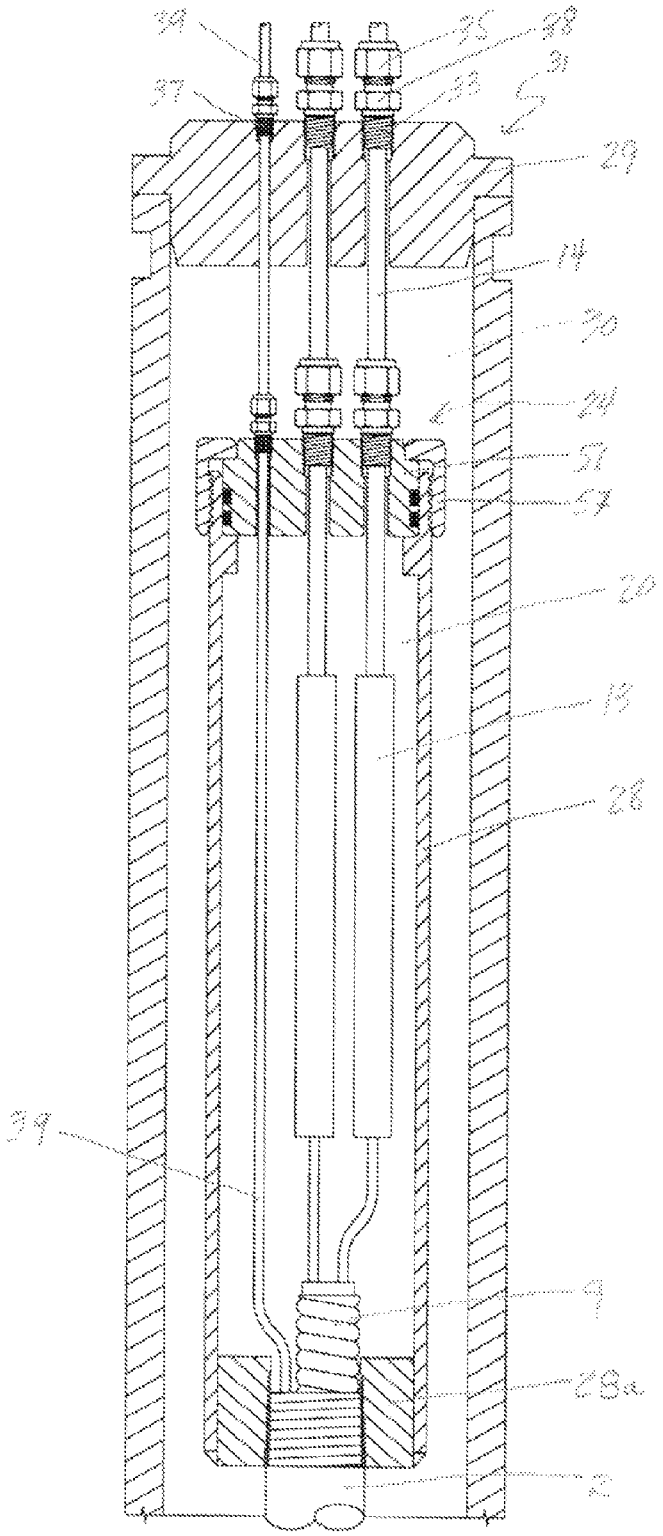
FIG. 2 is a schematic cross-sectional drawing of another form of the sealed coiled tubing enclosing the sealed end within the annulus of a wellhead.

FIG. 2 is an alternative arrangement for this triple-sealed penetrator assembly providing a cap head 24 to the sealed shroud 28 through which the separated electrical conductors pass as they proceed through the third seal 31 in the stuffing box cap 29. This view shows the interior space 20 in the shroud 28 sealed from the wellhead annular space 30. The stuffing box cap 29 is connected to a wellhead in a manner well known in this art to seal the shroud 28 over the top of the coiled tubing 2. Into this cap 29, a plurality of threaded surfaces 33, 37 are machined to accommodate connection of ferrule compression fitting nipples 35, 38 on both the electrical conductors and any capillary tube 39.

The interior shroud 28 is sealed at the top by the cap head 24 which is comprised of an head element 51 providing threaded passages for sealing each of the tubes covering the electrical conductors or the capillary tube at the top of the sealed shroud 28. The top cap head 51 is inserted within the shroud 28 and is seated on an interior shoulder, then the cap head nut 57 is screwed down to seal the connection in the shroud 28. At the bottom of the shroud 28, a threaded connection is made with the top of the coiled-tubing 2 threaded to engage and seal the threaded surface of an the shroud bottom 28*a*. Splices, as before, terminate the electrical conductors within sleeves 13 as described in FIG. 1 and in the prior United States patent described above, providing a connection between the #4 pump cable 9 carried within the 2⅜" coiled tubing 2 and the surface connected electrical conductors carried in the tubing 14 sealed within the shroud 28.

Figure 3:
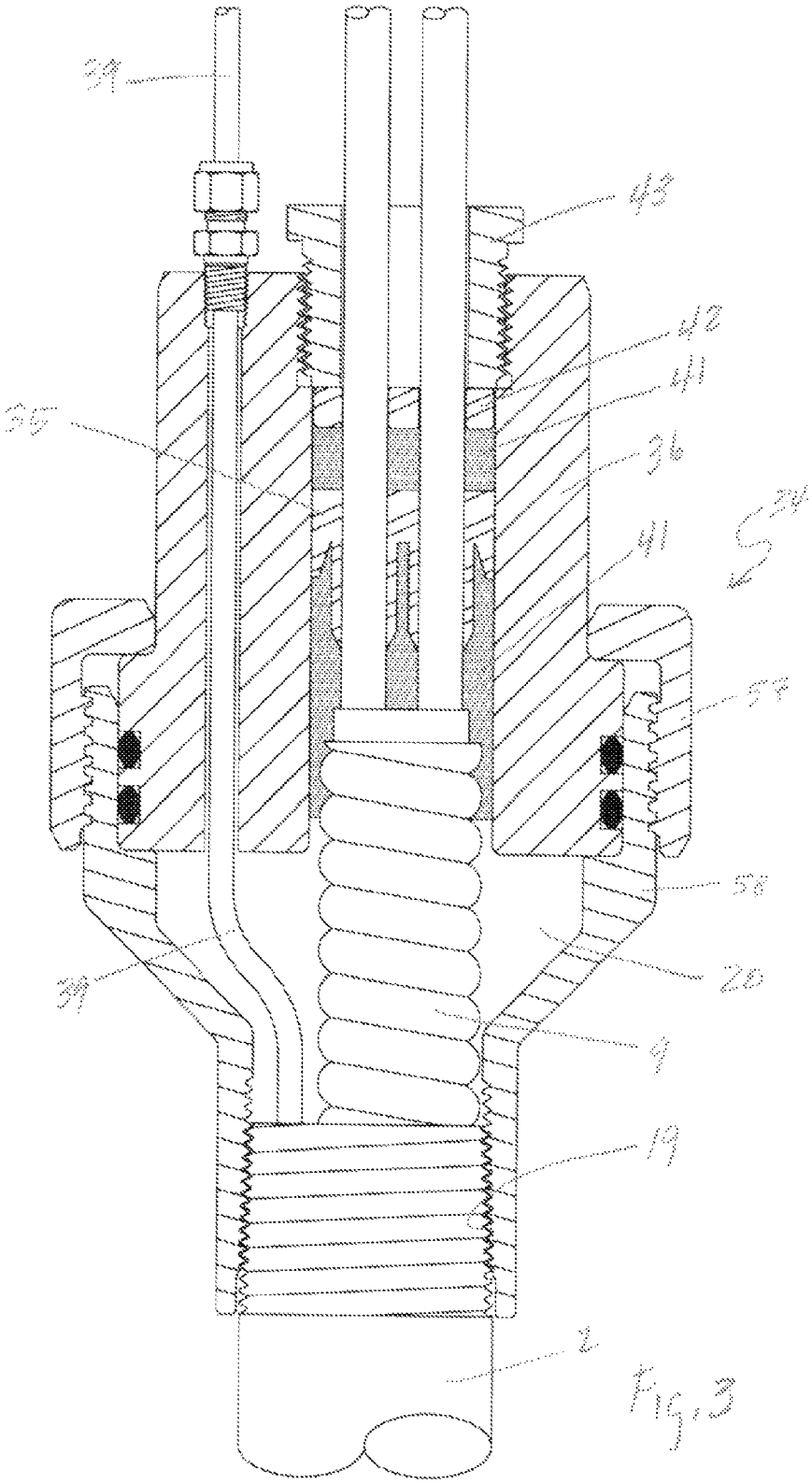
FIG. 3 is a schematic cross-sectional drawing of another form of the sealed coil tubing showing the termination of the sealing arrangement within a cap head nut and a capillary tube through said nut.

FIG. 3 is yet another alternative embodiment for this triple-sealed assembly apparatus operating to provide the seal by a cap head connector 34 housing a cable seal assembly 35 compressed within the body of the cap head attachment 36. The sealed space 20 is contained within the cap head connector 34 and the threaded connection 19 to the coiled tubing 2. ESP cable 9, enclosed within the coiled tubing 2, is taken from the terminal end of coiled tubing 2. The entire cap head connector 34 is sealed within the wellhead preventing vapors from moving from the coiled tubing into the wellhead. This seal arrangement uses an epoxy seal 41 surrounding the cable seal assembly 35, and is held within the cap head attachment 36 by additional epoxy 41, a three-holed washer 42 held within the body by plug 43 threaded into the top of the cap head connector 34. This seal arrangement is a substitute for the arrangement shown in either FIG. 1 or FIG. 2. Again, the capillary tube 39 can be installed within this arrangement, but is not required for this assembly.

Figure 4:
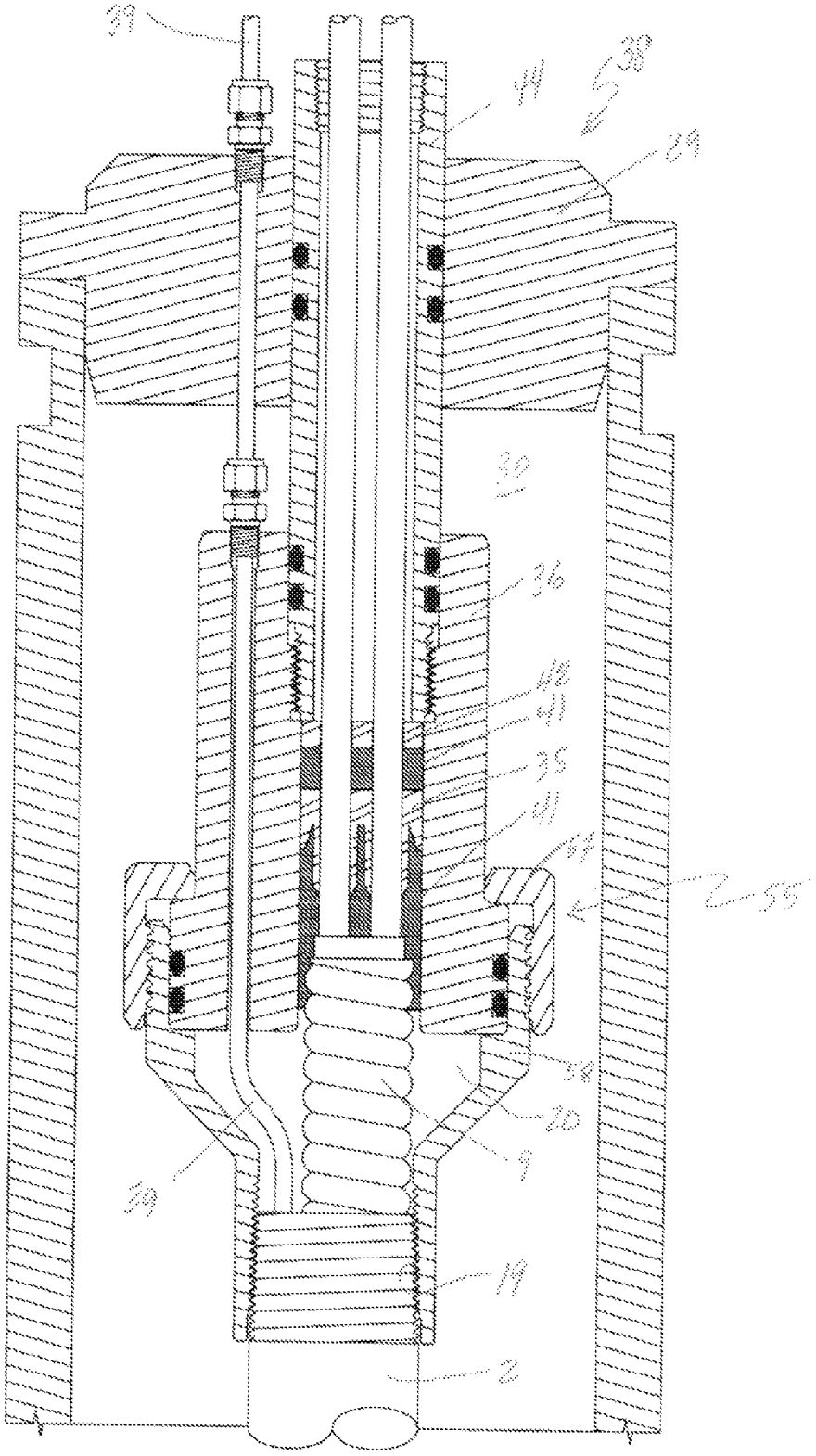
FIG. 4 is a schematic cross-sectional drawing of yet another embodiment of the triple-sealed arrangement showing the sealed end of the coiled tubing in a cap head nut arrangement and having an extending plug through the stuffing box cap to the wellhead, creating a triple-sealed arrangement.

FIG. 4 depicts another embodiment showing a cable seal assembly 35 providing a connecting tube 44 to a stuffing box connection 38 sealing the coiled tubing connector 55 and providing a sealed passage for the ESP cable 9 from the cap head screw body 58 through the stuffing box cap 29 to the surface electrical connection (not shown). The cap head screw nut 57 creates a seal between the end of the coiled tubing 2; sealing, in space 20, the coiled tubing 2 from the annular space 30. The first seal is created in the cap head body 58 at the threaded connection 19 to the coiled tubing 2. Epoxy 41 is inserted over the end of the ESP cable 9 within the cap head body 36 to which is inserted the connecting tube 44 from the stuffing box 29 of the wellhead 38.

The method of using this triple-sealed arrangement, as shown in FIGS. 1-4, is straightforward once the arrangement for the apparatus is determined. To install an ESP within a well bore into a producing zone on a coiled tubing is easily accomplished with a coiled tubing injection head in a manner well known in the industry. Once the coiled tubing 2 is installed and hung in the well bore, the electrical conductors carried in the standard pump cable 9 within the coiled tubing 2 are terminated or connected to the conductors from the surface. Each electrical conductor is separated from its insulation and cable 9 and inserted in a sleeve 14 or tube 44 for insertion through the wellhead penetrator 50, 29 into the interior of the wellhead. Each conductor is then spliced to the conductors coming from the coiled tubing 2. The capillary tubing 39, if present, is either connected to the capillary tubing proceeding from the coiled tubing or continues therefrom by inserting the tube through the interior seal head 11, 55, 24, or 34. The shroud 8, 28, 58 of each embodiment of this invention are connected to the top of the coiled tubing 2 previously hung within the well bore. At this point, a cap or cap nut 16, 57 is installed on the top of the shroud or sleeve 8, 28, 58 and then tightened. Since the cap allows the retaining nut 16, 57 to be installed after the connection are made to the ferrule compression fittings for both the electrical conductor tubes and the capillary tubes, no screwing action is required to seat the internal seal of the triple-sealed assembly creating the seal of the annular spaces 20 and 30. This allows rapid installation of the coiled-tubing ESP while preserving the seals at the wellhead and around the electrical conductors from migrating hydrocarbon vapors.

The particular embodiments and methods disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. An apparatus comprising:

a first pressure seal between a proximal terminal end of a coiled tubing suspended in a well bore tubular and a sealed interior chamber, accommodating the passage of electrical conductors from the interior of the coiled tubing and a penetrator assembly, into the sealed interior chamber;

a second pressure seal on the penetrator assembly sealing the electrical conductors extending from said sealed interior chamber and an exterior space beneath a wellhead and an interior surface of the wellhead;

a third seal on each electrical cable extending through the well-head from the second pressure seal; and, a connector for each of a plurality of electrical cables sealed within the interior chamber extending from the sealed interior chamber to an exterior to the well head;

whereby fluids traveling up the coiled tubing will be contained wholly within the sealed interior chamber and fluids at the well head will be excluded from entry into the sealed interior chamber connected to the coiled tubing.

2. The apparatus of claim 1 wherein the connector also provides a capillary tube connection adapted to permit a capillary tube to be introduced into a well bore and down a sealed coiled tubing.

3. The apparatus of claim 1 wherein the connector is a threaded sleeve attached to a coiled tubing terminal end.

4. The apparatus of claim 1 wherein the seals are metal-to-metal compressive seals.

5. The apparatus of claim 1 wherein the seals are PEEK compressive seals.

6. A method of installation for a coiled tubing penetrator sealed within a wellbore comprising:

creating a threaded end on a coiled tubing;

stripping the electrical conductors carried in the coiled tubing;

enclosing each of the conductors in a sealed threaded connector shroud and connecting each conductor from the sealed threaded connector shroud through a pressure-sealed wellhead.

7. A method of installation for the coiled tubing penetrator sealed within a wellbore of claim 6 further comprising hanging the coiled tubing suspending an ESP from the wellhead in the wellbore.

* * * * *